US005261609A

United States Patent [19]

Roth

[11] Patent Number: 5,261,609

[45] Date of Patent: Nov. 16, 1993

[54] OIL BURNER NOZZLE

[76] Inventor: Jacques Roth, Zürcherstrasse 7, CH-8604 Volketswil, Switzerland

[21] Appl. No.: 855,567

[22] Filed: Mar. 23, 1992

[30] Foreign Application Priority Data

Oct. 28, 1991 [CH] Switzerland ..... 03141/91
Dec. 4, 1991 [CH] Switzerland ..... 03556/91

[51] Int. Cl.[5] ..... B05B 1/14

[52] U.S. Cl. ..... 239/462; 239/397.5; 239/590.5

[58] Field of Search ..... 239/590, 590.3, 590.5, 239/397.5, 462, 469, 493, 491

[56] References Cited

U.S. PATENT DOCUMENTS

| | | | |
|---|---|---|---|
| 2,602,006 | 7/1952 | Fahrbach | 239/462 |
| 2,664,312 | 12/1953 | Czarnecki et al. | 239/590.3 |
| 2,823,954 | 2/1958 | Olson | 239/493 |
| 3,793,690 | 2/1974 | Wayne | 239/590 |
| 4,360,156 | 11/1982 | Soth et al. | 239/601 |
| 4,384,679 | 5/1983 | Sikora | 239/462 |
| 4,438,882 | 3/1984 | Fréhner | 239/462 |
| 4,736,893 | 4/1988 | Norskov | 239/590.5 |

FOREIGN PATENT DOCUMENTS 2708138 8/1978 Fed. Rep. of Germany ..... 239/462

*Primary Examiner*—Andres Kashnikow
*Assistant Examiner*—Christopher G. Trainor
*Attorney, Agent, or Firm*—Speckman, Pauley & Fejer

[57] ABSTRACT

To improve the oil supply and to prevent retarded dripping of oil from an oil burner nozzle when the burner flame has been extinguished, oil supply members are made of a heat-insulating material and positioned in the interior. The oil supply in the nozzle is provided by a oil filter with one or a plurality of solid porous bodies having narrow oil supply conduits. It has been shown that a porous plastic material, in particular a sintered plastic material, is advantageously suited for this purpose. The nozzle head, which can be screwed directly into the oil pre-heater, may comprise a metal with good heat conducting properties or a ceramic material and, in contrast thereto, the oil supply members submerged into the oil are made of a heat-insulating material. Thus, it is not only possible to manufacture the oil burner nozzle in a cost-effective manner, but it also has a considerably improved dripping effect, particularly if the oil supply members have a resistance control because of appropriate porosity or a sponge-like structural design.

14 Claims, 5 Drawing Sheets

OIL BURNER NOZZLE

BACKGROUND OF THE INVENTION

1. Field of the Invention

This invention relates to an oil burner nozzle having a nozzle head with a nozzle bore as well as oil supply members, such as a retarding disk and an oil filter, particularly for direct screw connection with an oil preheater of an oil burner.

2. Description of Prior Art

In a home heating system the function of the oil burner nozzle as the muzzle piece is not only to spray the oil under pressure into the combustion chamber, but because of its structural arrangement and the intentional formation of a spraying pattern of the atomized oil it also considerably contributes to good combustion of the heating oil. A poor spraying pattern regularly reduces the efficiency of the entire heating system. For this reason, it has become the custom to check and, if required, readjust the oil spray effect of a burner nozzle in the course of normal maintenance of a heating system.

The area of the nozzle bore, in particular of the very narrow tangential slits in the retarding disk directly ahead of the nozzle bore, is a natural, often occurring trouble area because of the danger of blockage. Nozzle filters are presently used, almost without exception, for avoiding the danger of blockage and are also intended to catch fine dirt particles immediately ahead of the nozzle. Simple screens used in older conventional nozzles, which were intended more for retaining larger pieces of dirt, are useless with respect to fine particles. Filter inserts are almost exclusively used today which can also become blocked, particularly as the porosity of the filter material becomes relatively fine. Increased demands on the total degree of efficiency of combustion, together with continued reduction in the use of oil, make the greatest demands on the function of the oil burner nozzle.

In contrast to a pure water or steam nozzle, the oil burner nozzle is subject to at least one very particular requirement. The interior surface of the oil burner nozzle guides the preheated liquid oil to the outlet nozzle. The exterior of the nozzle extends with its nozzle tip directly into the combustion chamber. Thus, the oil burner nozzle is unavoidably and considerably heated. So that the nozzle can maintain a satisfactory degree of effectiveness together with long service life, in the known oil burner nozzles at least the nozzle head and the retarding disk are constructed of high quality chromium steel and the nozzle oil filter is constructed of a sinter metal.

Without a doubt, the problem of achieving long service life with continuous use of the oil burner nozzle is currently solved with the use of highly heat-resistant materials. However, recent complaints have arisen with respect to retarded drip as a trouble source. It is known that in many uses, the oil burner nozzles continue to drip after the burner flame is extinguished. The large the oil burner nozzle, the more often such retarded drip occurs which, in the extreme case, can lead to the formation of a pool of oil at the bottom of the combustion chamber. It is apparent that such retarded drip problem can result in damage. It has been attempted to avoid at least heavy afterflow by the interposition of special valves, analogously to the problem area of dripping prior to the ignition of the burner flame. Each drop of oil which is not correctly atomized results in degradation of the combustion, in particular in an increase in uncombusted fuel. Thus, retarded dripping always results in an increased output of uncombusted hydrocarbon compounds, which constitute a considerable portion of air pollution.

SUMMARY OF THE INVENTION

Thus it is one object of this invention to develop a cost-efficient oil burner nozzle which assures optimum function an in particular which prevents retarded drip.

This object is achieved by having at least a portion of the oil supply members comprising of a heat-insulating material, or by having the oil supply conduits inside the oil burner nozzle at least partially made of heat-insulating materials.

According to this invention, it is shown that additional problems are created by conventional attempts to solve the existing problems by concentrating only on maximizing heat resistance of the materials. With this invention, it is apparent that highly heat-resistant metals can resist the effects of the heat of an oil flame over a long service life.

As long as the flame is burning, fresh air and preheated oil at 70° C. to 80° C. flow, so that sufficient heat is removed from the oil burner nozzle. But as soon as the burner flame is extinguished, the flow of fresh air and heating oil stops.

In this case, the oil burner nozzle is subjected to comparatively high heat radiation, at least in the area of the outlet nozzle. This is the case particularly if ceramic blocks are present in the combustion chamber. Regarding the present problems, metals have multiple negative properties because they not only quickly absorb heat, but are also good heat conductors and have a large heat retention capacity. Thus, the metallic parts transmit heat they have received and retained to the oil in the nozzle by means of direct heat conduction and thereby heat the oil. Then the heated oil droplets can exit in the area of the nozzle because of a natural increase in volume and the fact that they are otherwise contained on all sides. Furthermore, a heat balance of the entire heated oil burner nozzle, including the oil preheater and the oil under pressure contained therein has never been performed. Heated oil, even though in relatively small amounts, continues to flow out of the prechamber of the nozzle until sufficient cooling has been attained and exits in droplets. With the known solutions, this lasts until superheated wall elements no longer radiate heat into the combustion chamber and is continued after every time the burner flame is extinguished.

This problem can be considerably reduced by this invention since at least a portion of the oil supply members are made of a heat-insulating material. In contrast to metal, heat-insulating materials have exactly opposite properties and since heat is not very well absorbed, very little heat is retained and thus heat is poorly transmitted. In this way, the amount of heat radiation from the combustion chamber into the oil of the nozzle, after the flame is extinguished, is reduced to a minimum. Not only is retarded dripping due to heat effectively prevented, but it is also possible to design and sheathe the combustion chamber. Ceramic portions of the combustion chamber which continue to radiate heat are now no longer a nuisance.

This invention has a considerable number of particularly advantageous embodiments. For example, the oil filter and in particular the primary filter are preferably made of a heat-insulating material, particularly preferred is a porous sintered plastic material. This has the advantage that the filter, essentially submerged in the oil, absorbs relatively little heat from the nozzle head, and retains relatively little heat and only minimally transfers heat to the oil.

According to one preferred embodiment of this invention, the oil filter is essentially made from a solid body, in which one or a plurality of narrow conduits are provided so that the oil can flow in the direction of the oil flow, to increase the filtering effect. Thus, it is possible to reduce the free volume of oil in the nozzle and to increase the filter path without any disadvantage with respect to the previously mentioned heat problems. The solid body can also be of greater length than that of the conventional oil filters. To increase the effectiveness of the filter, the filter body preferably has a rough porosity on the outside at the oil inlet end and a finer porosity towards the inside, which keeps the dirt particles at correspondingly different levels.

The oil filter ca be constructed of a heat-insulating material, preferably having colors in a range from white to yellow, as visual indicator colors of contamination. In accordance with another preferred embodiment of this invention, it is possible to choose the coloring for indicating the flow rate in kg/h, for example, yellow for a low flow rate and white for a high flow rate. This color scheme can provide maintenance personnel with a simple indication of the types, for example in case the oil burner nozzle must be replaced.

It is also possible to position in the oil filter an insert for reducing the interior volume of the filter, which preferably is of a non-metallic material. The oil filter and the insert can be made of one piece or separate pieces.

A detailed inspection of a conventional oil burner nozzle shows that a number of influencing factors, although known, have not been taken into consideration for the design of the components. Super-light heating oil has properties very similar to that of creep oil. The oil pre-heater can be considered to be a small oil reservoir, having a narrow bore in the center. Depending on the particular structural design, it is possible for oil to drip out of the continuously open nozzle bore until the median oil level has been attained. Another problem arises when a certain amount of air or, respectively, gas is contained in the oil, which can collect in the form of bubbles in the oil pre-heater. In contrast to the gas, the bubbles can be compressed which has the result that corresponding to the degree of compression of the bubbles, an amount of oil drips out until the air bubble is free of pressure.

For this reason, according to one preferred embodiment of this invention in the heat-insulating material of the oil filter is provided a resistance control, or pressure barrier, by means of an appropriate structural design in such a way that essentially no oil flows below a certain pressure, for example 1.5 bar. By selecting a sponge-like interior part of the filter, or a structural design having a capillary function, a particularly effective pressure barrier is achieved which at a slight overpressue, and particularly in a pressure-free state, prevents free dripping, such as that of a leaky faucet. The oil filter which is made of a porous material can be directly attached to the nozzle head in the form of a clamped body, for which purpose it is possible to provide a thread in the plastic of the primary filter for a threaded connection with the nozzle head.

It is particularly cost-effective and advantageous in operation if the nozzle head consists of heat-resistant metal, i.e. its exterior is heat-conducting, while the filter connected to its inside is made of sintered plastic material and acts in a heat-resistant manner. By directly screwing the nozzle head to the oil pre-heater, also made of metal, it is possible to transfer the heat from the nozzle head, conducted by the metal, to the oil preheater housing. However, because of its physical properties, the filter which is submerged in the oil transfers almost no heat to the oil in spite of its connection with the hot nozzle head, corresponding to the example of heat insulation between the handle of a pan made of plastic and a pan made of metal, known from household use.

Furthermore it is also possible to make the nozzle head of a ceramic material and the oil supply members of a heat-resistant heat-insulating material. The primary filter and/or the secondary filter can be embodied so that they can be pressed into a metal nozzle head.

This invention will be described below in further detail by means of a number of preferred embodiments.

BRIEF DESCRIPTION OF THE DRAWINGS

FIG. 4 is a partial cross-sectional view of a burner nozzle assembly with the oil burner nozzle screwed in;

DETAILED DESCRIPTION OF THE PREFERRED EMBODIMENTS

Figure 1:
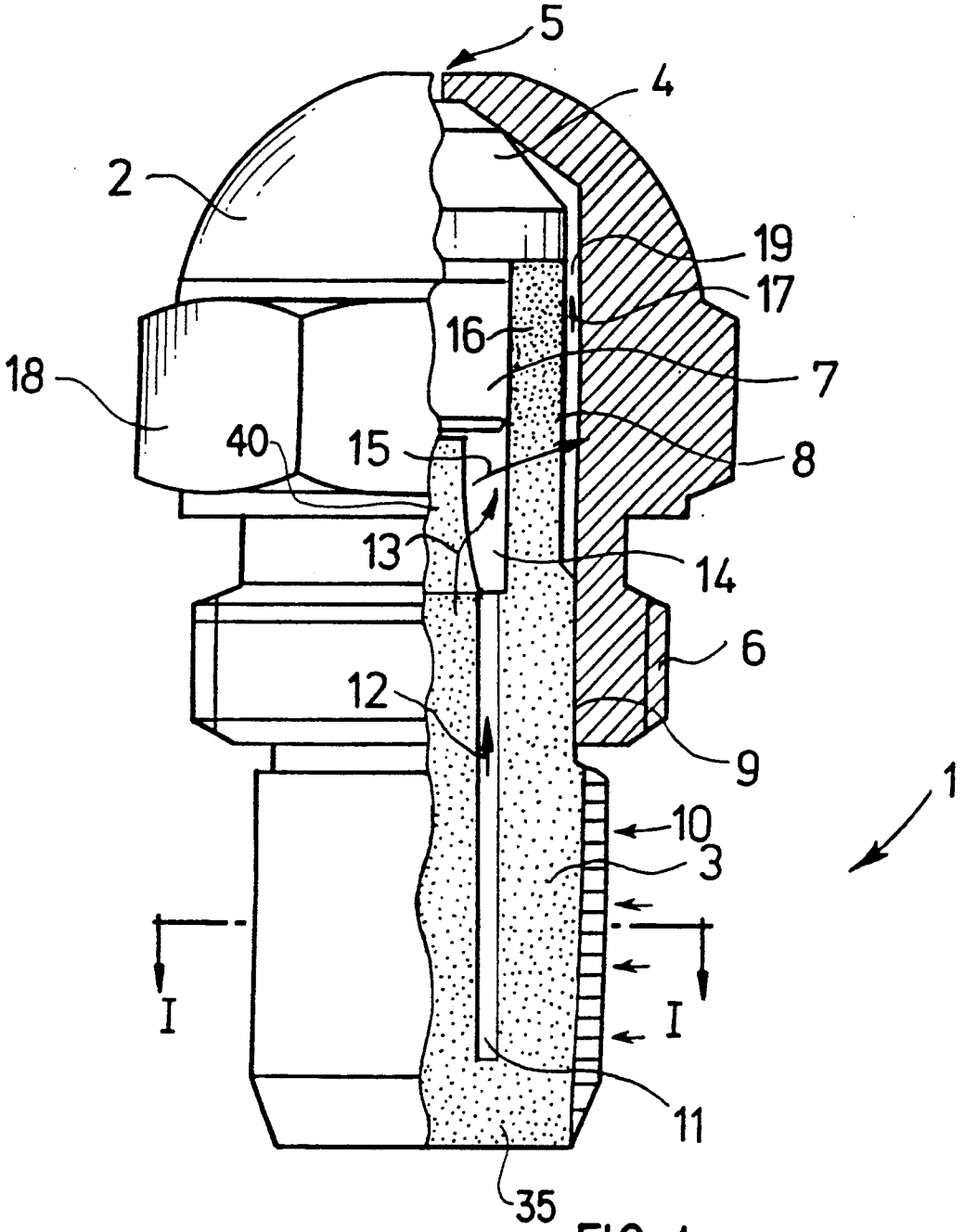
FIG. 1 is a partial sectional view of an oil burner nozzle, enlarged approximately five times.
Figure 1A:
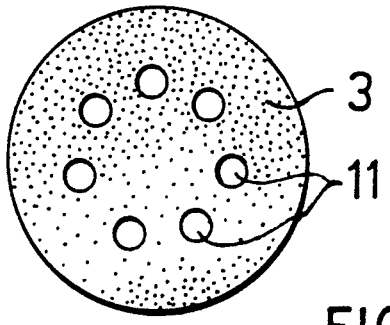
FIG. 1*a* is a sectional view taken along line 1*a*—1*a* of FIG. 1.
Figure 2:
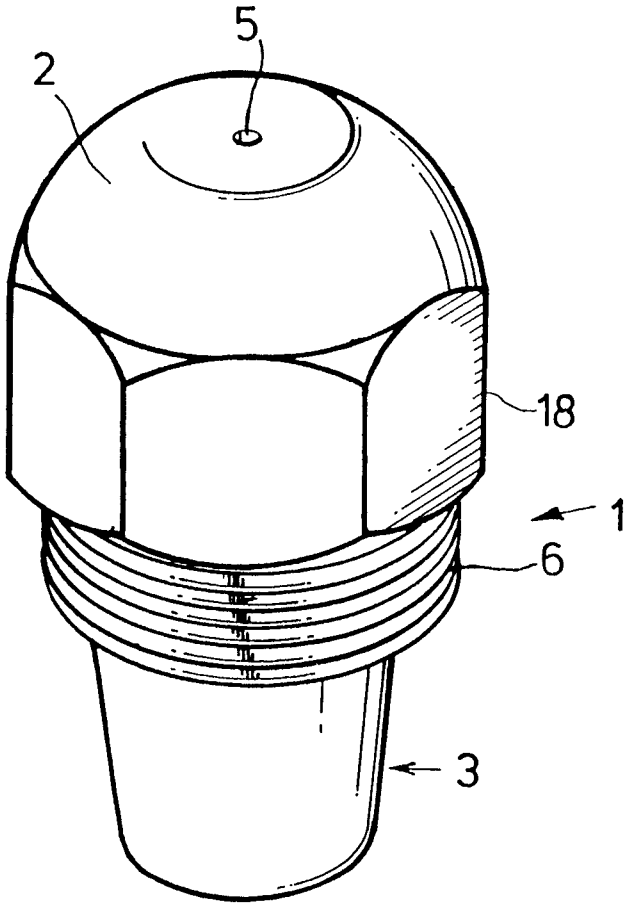
FIG. 2 is a perspective view of an assembled oil burner nozzle, also enlarged.

Referring to FIGS. 1, 1*a* and 2, an oil burner nozzle, 1 has the basic elements of a nozzle head 2, an oil filter 3 and a retarding disk 4. In the lower part, the nozzle head 2 has a screw thread 6 and its center part has a hexagonal shape and is provided with a nozzle bore 5. The retarding disk 4 is positioned directly in front of the nozzle bore 5 in the interior of the nozzle head 2. It is important that the retarding disk 4 is maintained in an exact position, which is assured by a neck 7 of the retarding disk 4 and an upper filter part 8. For this purpose, the oil filter 3 has a threaded connection 9, over which the filter is screwed into the nozzle head 2. The oil is essentially routed along the following path inside the oil filter 3: arrows 10 mark the inlet into the oil filter 3, the arrow 12 shows the path of flow within narrow conduits 11, which are disposed longitudinally in the lower filter part (35) which is otherwise embodied as a solid body, and arrow 13 indicates the flow change into an overflow conduit 14. In accordance with the arrow 15, the oil is further guided through a secondary filter 16. The arrow 17 indicates the flow within a flow-off conduit 19 ending directly on the top of the retarding disk 4 facing the nozzle bore 5. The volume of the overflow conduit 14 is reduced by a filler plug 40, which is also constructed of heat-insulating material.

Figure 3A:
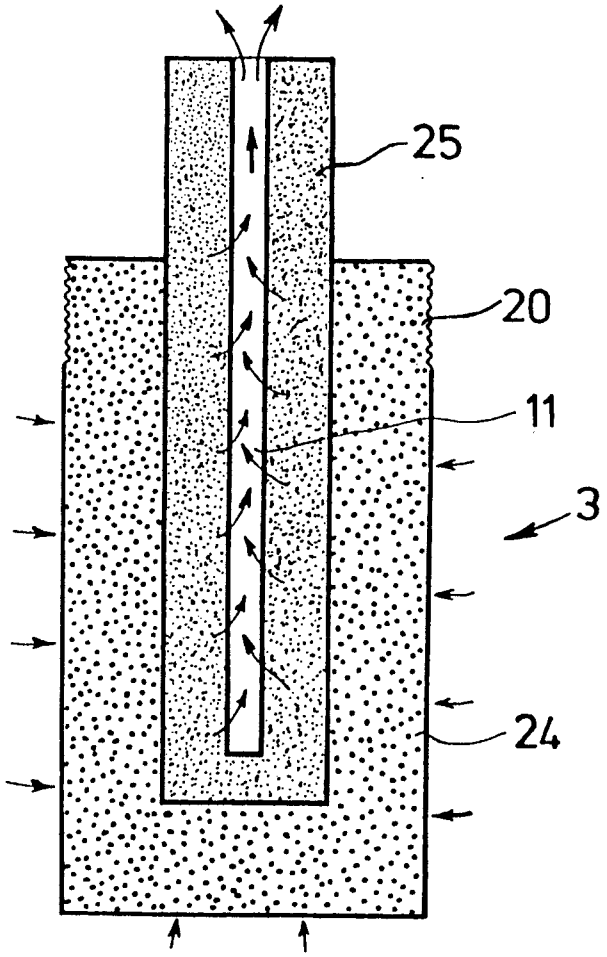
FIG. 3*a* is a cross-sectional view of the oil filter with oil supply members.
Figure 3:
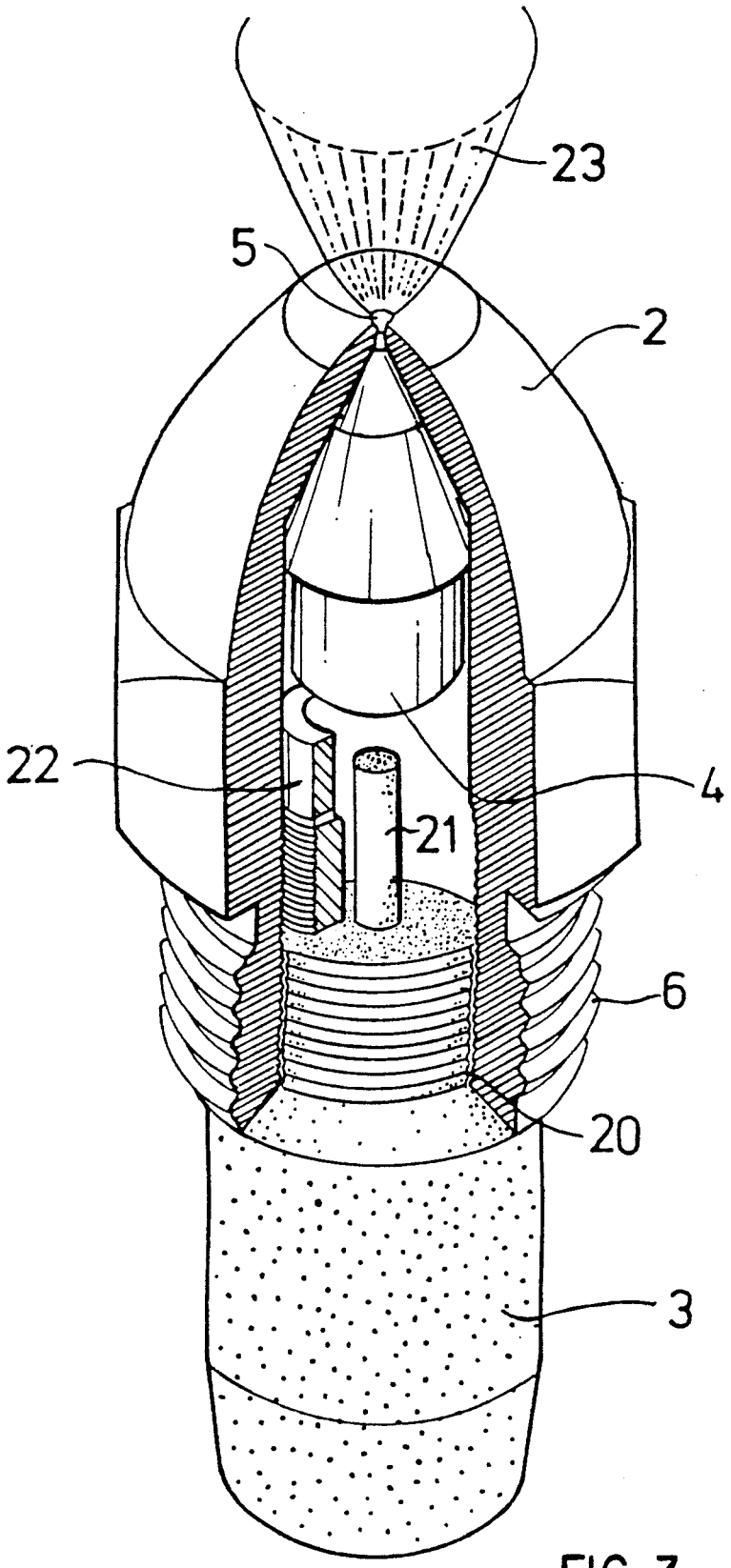
FIG. 3 is a cutaway perspective view of a further embodiment of the oil burner nozzle.

Another preferred embodiment of a oil burner nozzle according to this invention is shown in FIG. 3, partially in a plan view and partially in a sectional view.

Similar to that as shown in FIG. 1, here too the oil filter 3 is directly screwed into the nozzle head 2 via a thread 20. An oil supply member 21 extends above the oil filter 3 in the upper central area. The oil supply member 21 at the same time has the function of reducing the volume of the hollow chamber. The retarding disk 4 is maintained in place with a fixing screw 22, known per se. The appropriate parts are shown somewhat distorted in FIG. 3 in order to clarify the interior oil supply members. A spray con 23 has been schematically illustrated in the area of the nozzle bore 5.

One preferred embodiment of the oil filter 3 is shown in section in FIG. 3*a*, which essentially comprises a main filter body 24 and an inner drip stopper body 25, both of which are preferably made of a heat-insulating material. For example, the outer main filter body 24 can comprise a porous sintered plastic material and essentially has a pure filtering function. However, here the drip stopper body 25 not only is of a finer porosity, but also has a structural shape similar to that of a sponge with strong capillary action. As a result, active suction and retaining effects are provided by the material, which may be similar in structure to the known writing tips of felt ink pens The penetration path into the drip stopper body 25 is very short, for example only 1 to 2 mm or less. In contrast thereto the flow-through area is large. This has the result that with minimum pressure forces the adhesion is great enough that the oil does not flow through. By increasing the pressure, for example, to around 10 bar, the desired oil flowrate can be assured and can flow off through the narrow bore 11.

Figure 4:
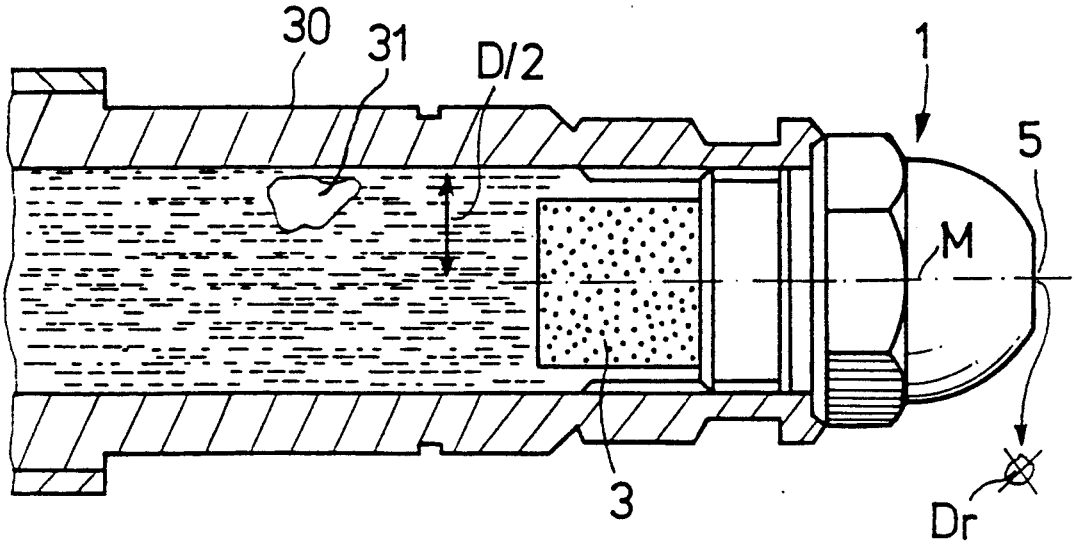
Figure 5:
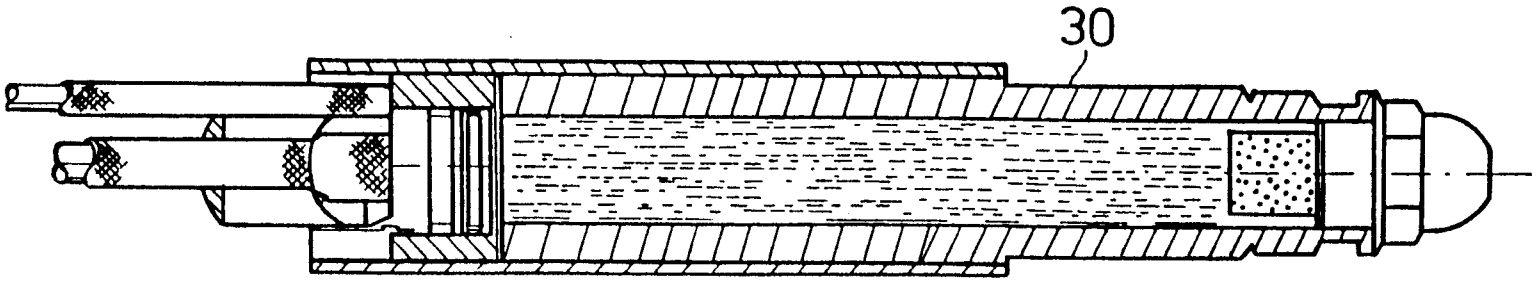
FIG. 5 is a partial cross-sectional view of the entire oil pre-heater.
Figure 5A:
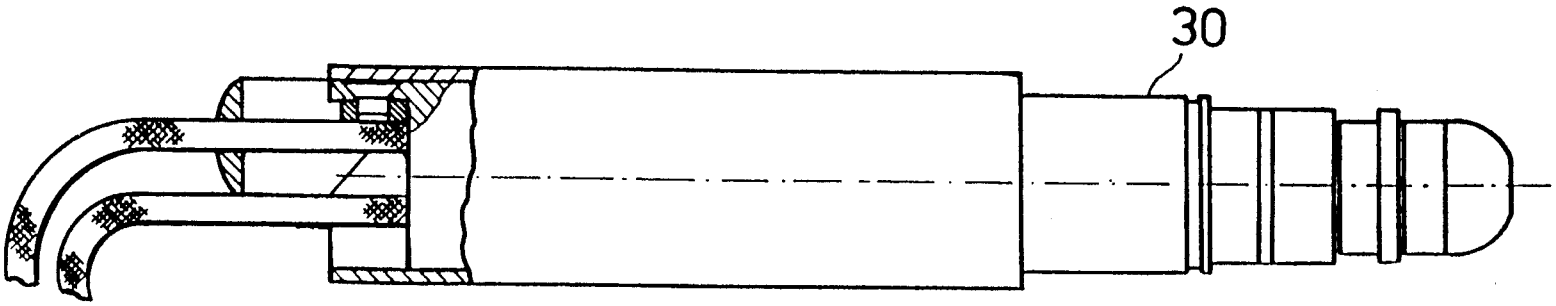
FIG. 5*a* is a partial plan view of the burner nozzle assembly shown in FIG. 5.

A burner nozzle assembly 30 with an oil burner nozzle 1, filled with oil as shown by the broken lines, is illustrated in FIGS. 4, 5 and 5*a*. An air bubble 31 has been drawn in FIG. 4 for clarification. Conventional means have been attempted to prevent such bubbles, however, it must be assumed that retarded dripping of the oil burner nozzle 1 is aided by their presence. It is only intended to indicate in FIG. 4, by the crossed-out drop "Dr", that the latter should be prevented. It can be further seen in the drawing figure that the upper half of the amount of oil in the burner nozzle assembly 30 is higher by the distance D/2 than the nozzle bore 5, so that by reason of the natural pressure gradient and the creeping ability of the oil, a relatively large amount of oil droplets can be discharged, depending on the circumstances, something which is intended to be prevented in accordance with this invention.

Figure 6:
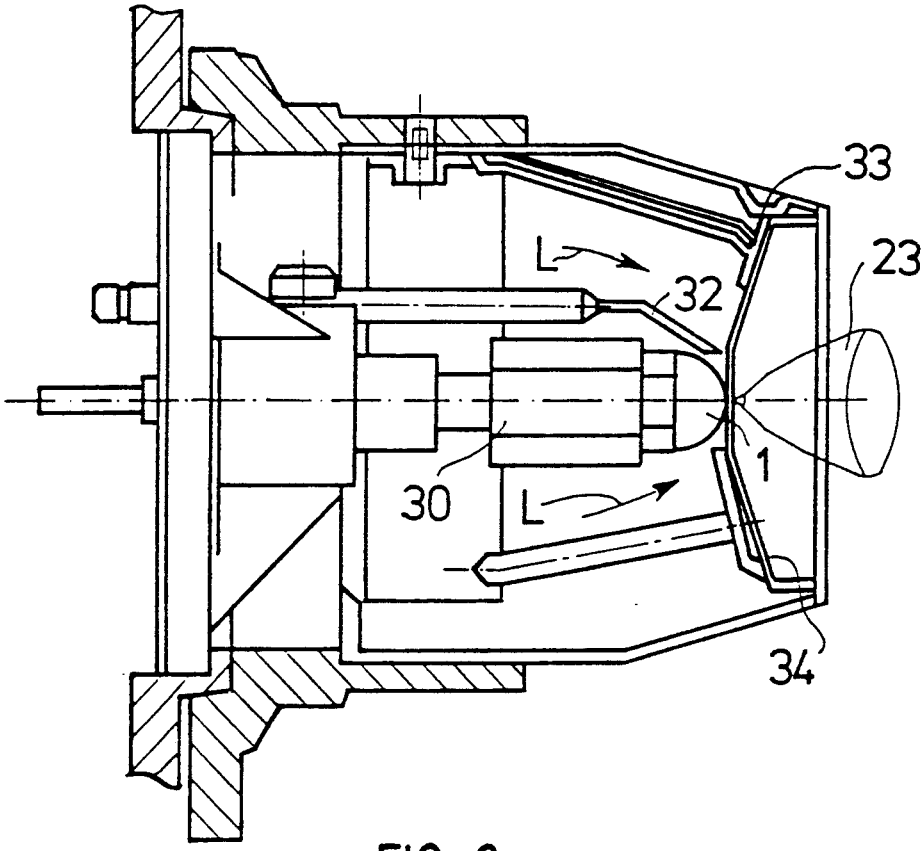
FIG. 6 is a partial cross-sectional view of the head of an entire oil burner.

FIG. 6 shows the head of an oil burner, together with the burner nozzle assembly 30, an ignition electrode 32, a photoelectric cell 33 and an air supply grid 34, through which air "L" is introduced into the combustion chamber.

I claim:

1. In an oil burner nozzle having a nozzle head with a nozzle bore and a retarding disk mounted within the nozzle head, the improvement comprising: the nozzle head (2) having a chamber, a main filter (3) having an upper filter part (8) mounted within the chamber forming a flow-off conduit (19) between the nozzle head (2) and the upper filter part (8), a lower filter part (35) of the main filter (3) having a plurality of longitudinally positioned narrow conduits 11, and at least a portion of the main filter (3) comprising a porous sintered plastic material.

2. In an oil burner nozzle in accordance with claim 1, wherein the porous sintered plastic material of the main filter (3) has a first porosity on an outside portion at an oil inlet portion and a second porosity towards an inside portion of the main filter (3), wherein the second porosity is finer than the first porosity.

3. In an oil burner nozzle in accordance with claim 2, wherein the main filter (3) has a color in a range of white to yellow.

4. In an oil burner nozzle in accordance with claim 3, wherein the main filter (3) has a resistance to flow whereby essentially all oil is prevented from flowing through the main filter (3) below a set pressure.

5. In an oil burner nozzle in accordance with claim 4, wherein the main filter (3) has an appropriate porous structural design for achieving the resistance to flow.

6. In an oil burner nozzle in accordance with claim 5, wherein the appropriate porous structural design is positioned within the upper filter part (8).

7. In an oil burner nozzle in accordance with claim 6, wherein the main filter (3) is sealably attached directly to the nozzle head (2).

8. In an oil burner nozzle in accordance with claim 7, wherein the nozzle head is of a ceramic material.

9. In an oil burner nozzle in accordance with claim 8, wherein the main filter (3) is connected directly with the nozzle head (2), and the upper filter part (8) secures the retarding disk (4) in a fixed position.

10. In an oil burner nozzle in accordance with claim 1, wherein the main filter (3) has a color in a range of white to yellow.

11. In an oil burner nozzle in accordance with claim 1, wherein the main filter (3) has a resistance to flow whereby essentially all oil is prevented from flowing through the main filter (3) below a set pressure.

12. In an oil burner nozzle in accordance with claim 1, wherein the main filter (3) is sealably attached directly to the nozzle head (2).

13. In an oil burner nozzle in accordance with claim 1, wherein the nozzle head is of a ceramic material.

14. In an oil burner nozzle in accordance with claim 1, wherein the main filter (3) is connected directly with the nozzle head (2), and the upper filter part (8) secures the retarding disk (4) in a fixed position.

* * * * *